US006064294A

United States Patent [19]

Schwarze et al.

[11] Patent Number: 6,064,294

[45] Date of Patent: May 16, 2000

[54] TEMPERATURE SWITCH, PARTICULARLY ADJUSTABLE TEMPERATURE REGULATOR

[75] Inventors: Manfred Schwarze, Oberderdingen; Martin Roth, Kraichtal, both of Germany

[73] Assignee: E.G.O. Elektro-Geratebau GmbH, Germany

[21] Appl. No.: 09/325,218

[22] Filed: Jun. 3, 1999

[30] Foreign Application Priority Data

Jun. 4, 1998 [DE] Germany ..... 198 24 871

[51] Int. Cl.[7] ..... H01H 37/38; H01H 37/40; H01H 37/42

[52] U.S. Cl. ..... 337/321; 337/298; 337/317; 337/318; 337/320; 337/396; 29/622; D10/50

[58] Field of Search ..... 337/298, 321, 337/320, 304, 306, 312, 314, 315, 317, 318, 327, 393, 396, 398, 417; 236/101 D; 324/417; D10/50; 29/622

[56] References Cited

U.S. PATENT DOCUMENTS

| | | | |
|---|---|---|---|
| 1,903,924 | 4/1933 | Irwin | 337/319 |
| 2,821,605 | 1/1958 | Baker | 337/314 |
| 3,274,362 | 9/1966 | Frendock | 337/314 |
| 3,354,280 | 11/1967 | Slonneger | 337/319 |
| 3,820,049 | 6/1974 | Kautz | 337/319 |
| 4,260,977 | 4/1981 | Kicherer et al. | 337/318 |
| 4,295,114 | 10/1981 | Pohl | 337/3 |
| 4,565,989 | 1/1986 | Lotter et al. | 337/311 |
| 4,626,819 | 12/1986 | Drapeau | 337/323 |
| 4,791,397 | 12/1988 | Wells | 337/354 |
| 4,794,363 | 12/1988 | Hirata et al. . | |
| 5,032,818 | 7/1991 | Zanon et al. | 337/319 |
| 5,311,165 | 5/1994 | Kadlubowski | 337/323 |
| 5,315,281 | 5/1994 | Mount | 337/319 |

FOREIGN PATENT DOCUMENTS

| | | | |
|---|---|---|---|
| 0425752A1 | 5/1991 | European Pat. Off. | H01H 37/10 |
| 2 217 080 | 11/1972 | Germany . | |
| 2 156 509 | 5/1973 | Germany . | |
| 27 24 527 | 12/1978 | Germany . | |
| 32 23 461 | 12/1983 | Germany . | |
| 32 36 255 | 4/1984 | Germany . | |
| 38 75 186 | 10/1992 | Germany . | |
| 44 35 303 | 4/1996 | Germany . | |
| 196 27 969 | 1/1998 | Germany . | |
| 2-195622 | 8/1990 | Japan | H01H 37/38 |

*Primary Examiner*—Leo P. Picard
*Assistant Examiner*—Anatoly Vortman
*Attorney, Agent, or Firm*—Quarles & Brady LLP

[57] ABSTRACT

A temperature regulator operating with a hydraulic expansion capsule or diastat (5) has a lever mechanism (30) for force transmission between the diastat and the switch spring (21) of a snap switch (20). For protecting the switch spring against overloading, into the lever mechanism is integrated a buffer or shock absorber, which is elastically flexible above a limit force associated with the operating force of the switch spring in the switching point and below the limit force is substantially rigid. The standard unit formed by the shock absorber and the lever mechanism is formed by a rocker (31) in the form of a sheet metal bent part, which has a L-shaped pivot lever portion (40), with which is constructed in one piece a stop-limited opening clip spring (41) pretensioned in the opening direction.

22 Claims, 2 Drawing Sheets

(a)
(b)

TEMPERATURE SWITCH, PARTICULARLY ADJUSTABLE TEMPERATURE REGULATOR

BACKGROUND OF THE INVENTION

The invention relates to a temperature switch, particularly an adjustable temperature regulator.

A temperature switch according to the preamble has a temperature-sensitive expansion element, which acts on a switch spring of a snap switch by means of a force or power transfer means. There is also an overload safety device for the switch spring. The overload safety device has at least one shock absorber or buffer, which cooperates with the force transfer means between the expansion element and the switch spring and is in particular installed in the force flow of the force transfer means. The shock absorber is dimensionally variable or flexible above a force limit associated with the operating force of the switch spring in the switch point, whereas it can be substantially inflexible or rigid below the temperature limit.

Such a temperature switch is known from DE 196 27 969. It has a rocker serving as a force transfer means or force-transmitting force transfer element, which is operated by an expansion capsule or diastat of a thermo-hydraulic expansion system by means of an interposed shock absorber element and acts on the snap spring. The shock absorber element comprises a closed capsule formed from two cup-shaped, interengaging halves, between which is pretensioned a compression spring. The shock absorber transfers in a completely rigid manner the switching force of the diastat in the force range in which the snap spring operation takes place, whereas it is flexible and telescopically slides together with an overload exceeding the same. A metal capsule half of the three-part shock absorber element is fitted in fixed manner to the diastat. During the fitting of the temperature regulator the spring is inserted, for producing a pretension it is compressed with the aid of the other capsule part and the capsule parts are interconnected by bending over claws. During the further fitting the shock absorber element fixed to the expansion element is mounted on the operating lever. This system functions in a satisfactory manner, but has a highly complicated manufacture, particularly during installation or fitting.

SUMMARY OF THE INVENTION

The problem of the invention is to provide a temperature switch of the aforementioned type, which can be inexpensively manufactured and easily assembled.

This problem is solved by a temperature switch having the features of claim 1.

According to the invention the shock absorber and the force transfer means constitute a standard unit referred to as a cushioned force transfer unit, i.e. a standard unit, which combines both the functions of the force transmission between the expansion element and the switch spring and also the function of the shock absorber, which below its limit force acts as a rigid force transmission element, but above its limit force introduces a certain flexibility into the force transmission. The invention makes it possible to prefit complete snap-action mechanisms essentially formed by the load-dependently cushioned or damped force transmission unit and the snap switch as a subassembly, e.g. to a base of the temperature switch and independently of the expansion system. For further installation purposes the subassembly comprising the expansion element can be mounted and optionally adjusted, without it being necessary to provide a fastening between the expansion element and the snap-action mechanism. As a result of the integration of the overpressure protection device formed by the shock absorber in the force transfer means, it becomes possible to use for such temperature switches commercial, standardized expansion elements, because the complete devices are integrated for overload prevention purposes into the snap-action mechanism and in particular into the force transfer means operating the switch spring. In addition, in the case of a cushioned force transmission unit, the relative position of shock absorber and force transfer means is fixed prior to the assembly of the temperature switch, which makes it possible to minimize switching imprecisions caused by geometry.

In preferred embodiments the force transfer means has a lever mechanism with at least one lever, which is preferably supported on one side in the manner of a knife-edge bearing and/or which has a lever arm, which acts on the switch spring, preferably with a punctiform contact. A lever is a simple force transmission element, whose force transfer can be selected over the effective lever lengths. Force transfer can take place 1:1, but preferably acts in force-increasing or force-decreasing manner. A transfer lever can be used for increasing the snap spring sensitivity. A particularly simple embodiment is obtained with a substantially L-shaped lever, which is either hung onto a switch spring support and is supported there or can be guided in a recess of the switch spring support or in a separate recess, e.g. of the switch base.

An embodiment particularly effective for preventing switch spring overpressure is characterized in that a stop member is provided on which the lever, particularly the lever arm acting on the switch spring is preferably directly supported after overcoming the switch point for the switch spring. The support can end the movement of the lever after the desired switching process has taken place and well before the elastic range of the spring has been exceeded and the latter could be permanently damaged possibly by excess pressure and the resulting plastic deformation. The stop member is preferably formed by a projection of a switch spring support and in particular by the switch tongue abutment. However, it is also possible to form the stop member by a projection or portion of the switch base and/or optionally to provide a separate lug or shoulder fulfilling a supporting function on the lever arm path-limited by the stop member or at some other point on the lever. When the lever has reached its stop position and the expansion element further expands, then the shock absorber of the force transmission also creates an overpressure protection for the expansion element and the remaining temperature switch mechanism. It is also possible to provide a direct stop member for the lever in temperature switches according to the preamble, e.g. those according to DE 196 27 969.

An embodiment having a particularly small number of active components in the force transmission and which is consequently less fault-prone, is characterized in that the shock absorber comprises at least one pretensioned self-restraining or self-limiting spring element in the spring direction, particularly in the expansion direction. Thus, for limiting the spring deflection there is no need for components separate from the spring. The spring element is preferably in the form of a preferably U-shaped bent clip spring pretensioned in the opening direction of its legs and whose opening is limited by the spring's own stop member. Below a loading adequate for compressing the legs such a spring element is substantially rigid or dimensionally stable, whereas the legs can be compressed above a limit force. For the self-restraint of the spring element or for implementing the path limitation integrated into the spring element it is possible to provide at least one hook fitted to a spring portion, e.g. a leg and which can in particular be in the form of a bending strap or bar. The latter can engage behind a projection provided on another spring portion or leg. There is preferable a small-surface, e.g. linear or punctiform contact face on the stop member, so that the spring length or width in the stop-limited state is very accurately definable and even in the case of a multiple overloading and subsequent relief of the spring element remains reproducible.

A particularly easily assemblable and functionally reliable construction is obtained if the load-dependently cushioned or damped force transfer means, which can also be referred to as a buffer-lever subassembly, is a single, one-piece component, particularly a spring sheet metal-bending part. It can have both portions acting as levers and also portions acting as shock absorbers and in particular a portion forming a self-restraining clip spring. The lever or lever portion can have a L-shape and has e.g. two support legs laterally spaced from one another and forming a knife-edge bearing. Between the support legs is preferably symmetrically provided a self-limiting spring element forming the shock absorber and e.g. one leg of a clip spring forms with the bilaterally adjacent support leg portions a three-prong fork arrangement and the corresponding prongs are correspondingly bent in opposite directions for producing a damped rocker. Laterally projecting projections of the fork part can subsequently be engaged behind by bent round retaining straps on the sides of the other leg of the U-shaped clip spring and consequently the self-restraint of the latter is brought about.

Permanently operationally reliable temperature switches can in particular be created if the expansion unit comprises an expansion capsule or diastat of a thermohydraulic expansion system. As a result of the invention it is possible for the expansion unit and in particular the diastat, when the temperature switch is in the assembled state, is in unconnected engagement contact with the buffer-lever unit or an insulator resiliently fixed to the switch casing. Actual contact can be produced on installing the switch, without it being necessary to have separate connecting means, such as screws or soldered joints. Such a temperature switch can equally easily be dismantled for replacing any defective parts.

An electrical insulation between optionally live parts of the force transmission means and the expansion element can advantageously be brought about in that the buffer-lever subassembly is supported by means of a preferably pressure-rigid insulator made from electrically insulating, particularly ceramic material, on the expansion unit. The insulator can be fixed in detachable or non-detachable manner to the subassembly and can be installed together with the latter. The insulator can also be movable, particularly resilient, e.g. being fixed to the casing by means of a clip spring and therefore forming part of the casing assembly.

A particularly flat or shallow construction type can be obtained if, in place of the also possible diastat with two dish-shaped sheet metal membranes and a central nipple for a capillary tube, use is made of a flat membrane, in which the capillary tube, in the vicinity of the circumferential edge of the capsule passes substantially radially and directly into the interior of the latter without requiring a separate nipple.

Alternatively to the embodiments in which the shock absorber and force transfer means or lever mechanism form a single, one-piece component, it is also possible for the shock absorber to be an element firmly connectable or connected to the force transfer means and which prior to the assembly of the temperature switch is connected in a preferably non-detachable manner, e.g. by a rivet joint or welding to the force transfer means, particularly the rocker lever. The preferably length-variable shock absorber element can be constructed as a pressure element, which in the case of compressive loading below the intended limit force is substantially dimensionally stable and above the limit force is reversibly and preferably telescopically compressible. It is e.g. possible to use the three-part buffer elements known from DE 196 27 969 with two capsule parts engaging behind one another and surrounding a pretensioned compression spring, one capsule part being fixed to the rocker.

These and further features can be gathered from the claims, description and drawings and the individual features, either singly or in the form of subcombinations, can be implemented in an embodiment of the invention and in other fields and can represent advantageous constructions. The subdivision of the application into individual sections and the subtitles in no way restrict the general validity of the statements made thereunder.

BRIEF DESCRIPTION OF THE DRAWINGS

Embodiments of the invention are described in greater detail hereinafter relative to the attached drawings, wherein show:

FIG. 2(*b*) A larger scale detail view of the circled area in FIG. 2(*a*).

DETAILED DESCRIPTION

Figures 1, 2, 3, 4:
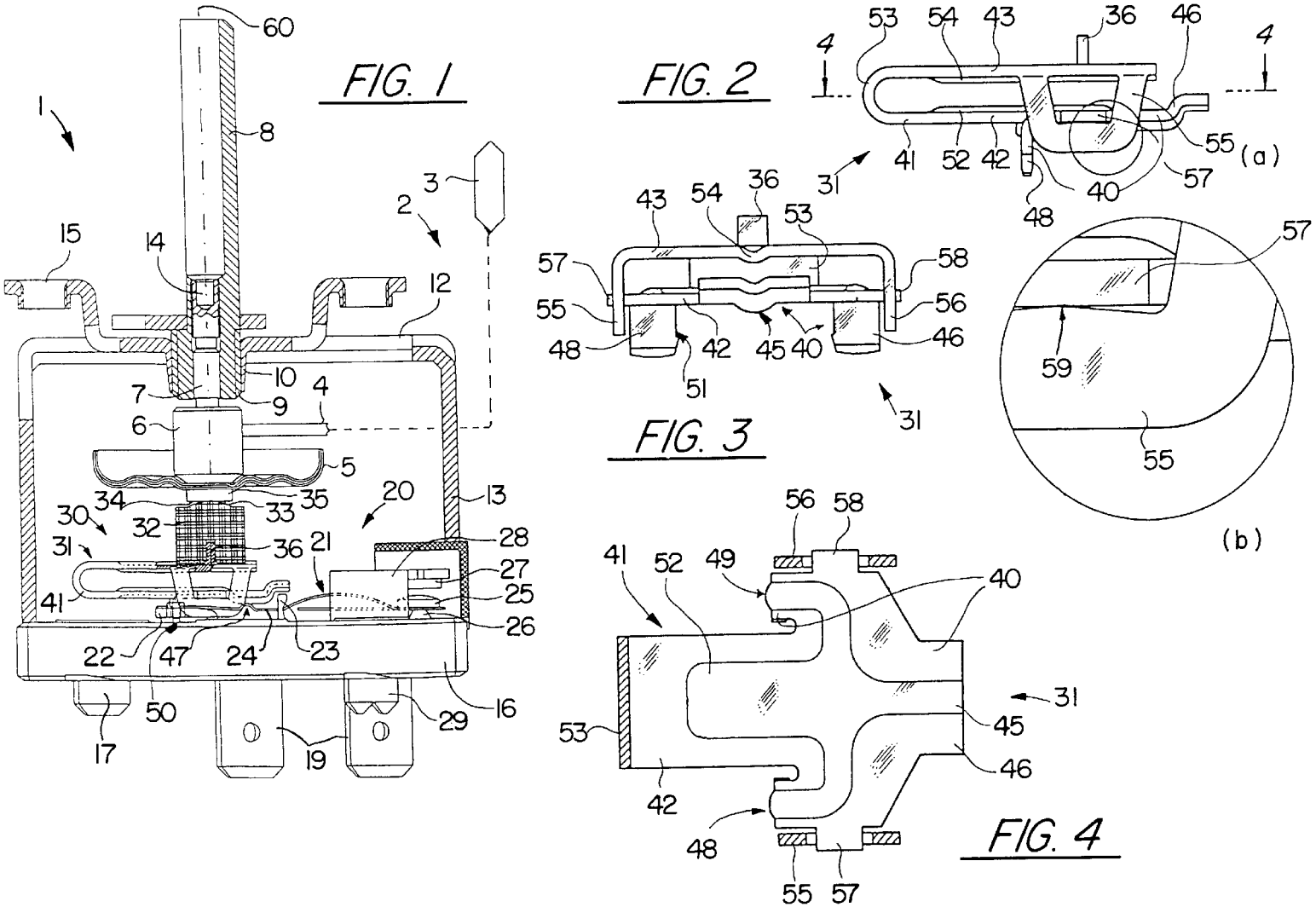
FIG. 1 A longitudinal section through an embodiment of a temperature regulator according to the invention.
FIG. 2(*a*) A side view of a buffer-lever unit constructed as a onepiece sheet metal bent part.
FIG. 3 A front view of the buffer-lever unit of FIG. 2.
FIG. 4 A plan view of the buffer-lever unit of FIG. 1 in section along line IV—IV of FIG. 2(*a*).

The longitudinal section in FIG. 1 shows the switching component of a first embodiment of a temperature regulator 1, which cooperates with a thermohydraulic expansion system 2. To the expansion system belongs a diagrammatically indicated temperature sensor 3 in the form of a tube filled with an expansion fluid and which is connected by means of a capillary tube 4 to an expansion element in the form of an expansion capsule or diastat 5. The diastat comprises two dish-shaped, corrugated sheet metal membranes, which are interconnected in pressure-tight manner by welding or soldering at their upwardly bent edges. By means of a nipple 6 positioned centrally in the dish of the diastat, the capillary tube 4 is connected to the interior of the cavity formed between the corrugated sheet-metal dishes. On the top of the nipple 6 a retaining bolt 7 is provided in one piece therewith and engages in a hollow control shaft 8. The latter has an external thread 9, which cooperates with an internal thread provided in a sleeve 10, which, in the top 12 of a box-shaped metal casing 13 is constructed in one piece with the latter. The control shaft 8 is flattened on one side in order to receive in non-rotary manner a control knob. In the latter is provided a setscrew 14, which acts on the retaining bolt 7 for the vertical adjustment thereof.

The casing 13 is made from sheet metal and is in the form of a rectangular, partly broken away box, on whose top 12 are shaped fixing clamps 15 for the installation of the temperature regulator. The casing underside is formed by a base part 16 of temperature-resistant, dimensionally stable, electrically insulating material, e.g. steatite or some other ceramic material. The casing 13 is fixed by twist straps 17 to the base 16. The plate-like base 16 carries a snap switch 20, which has a switch spring 21, which is fixed to a switch spring support 22. The switch spring support 22 is a relatively small, solid sheet metal part, which has a switch tongue abutment 23 in the form of an upwardly directed bend. On the switch tongue abutment is supported a switch tongue 24, which is separated by an approximately U-shaped indentation from the remaining switch spring. As a result of its outward bending and pretensioning which it gives to the switch spring, the latter fixed by its contact-remote ends by riveting to the switch spring support can snap round with its front end supporting the switch contact 25 at its switching point between two stable switching positions. In the off position shown in FIG. 1 the front end of the switch spring engages on a counterabutment-forming projection 26 shaped out of the base. In the on position the contact 25 engages on a countercontact 27, which is located on a countercontact bridge 28 by means of a pressure provided by the spring.

The snap switch support 22 and countercontact bridge 28 create, by U-shaped construction, mounting straps, which on the one hand are constructed as twist straps 29 and on the other as twist-fixed flat plug tongues 19 also providing the electrical connection to the underside of the plate-like base.

The snap switch 20 is so mechanically coupled in force-transmitting manner by means of a lever mechanism 30 acting as a force transfer means to the expansion element 5, that an expansion of the element 5, over and beyond a predeterminable, vertical amount, leads to an opening of the contact 25, 27. The lever mechanism 30 comprises a cushioned or damped rocker 31, whose construction will be explained in conjunction with FIGS. 2 to 4. With it is associated a ceramic insulating knob 32, which is fixed to the top of the rocker and is supported with its upwardly spherically curved top 33 in the centre of the large-surface, planar underside 34 of a metal disk 35 fixed to the underside of the diastat 5 on a punctiform contact point. The pressure-rigid, electrical insulating material of the ceramic knob 32 engaged on a vertically projecting fastening strap 36 of the rocker 31 ensures a rigid transmission of the vertical movement of the diastat bottom to the rocker 31 and creates the necessary electrical insulation between live parts of the snap-action mechanism 20, 30 and the diastat 5. The upwardly bent edges of the diastat also aid the maintaining of adequate electrical clearances between the snap-action mechanism and the expansion system. The large-surface, planar contact face for the convex top of the insulator 32 provided by the planar underside of the metal disk 35 ensures that the pressure ratios and therefore the switching precision of the regulator are substantially independently of minor positional tolerances of the diastat.

The rocker 31 constructed as a one-piece spring steel bent part fulfils several functions within the framework of the force transmission and overpressure protection. It comprises a substantially L-shaped lever portion 40 acting as a force transmission transfer lever and a U-shaped clip spring 41, acting as a shock absorber and constructed in one piece therewith, whose legs 42, 43 are pretensioned in the clip spring opening direction and which can open to a maximum, predetermined vertical amount limited by the stop member. Consequently it is a one-piece rocker with integrated overload damping means.

For creating clearly defined pressure ratios, the lever or lever portion 40 has a lever arm 46 provided with a central, toroidal embossing or stamping 45, with which it acts in punctiform manner on an actuating point 47 on a transversely directed bead of the switch spring. On the opposite end of the lever, which is wider than it is long, are provided two support legs 48, 49 bent downwards at right angles and having a large lateral spacing, their lower ends forming knife-edge bearings 50, in that they are supported on the surface of the base 16. As can be seen in FIG. 3, as a result of a curved lower edge of the support legs 48, 49 it is ensured that clearly defined support conditions are obtained.

From either side the two support legs project into in each case one recess in the lateral edge of the switch spring support 22, so that the said legs are guided therein. Projecting noses 51 on the inside of the support legs 48, 49 have a barb-like construction and ensure that the lever is not raised, after said lever 40 has been forced under pressure from above into the recesses.

Below the S-shaped, upwardly displaced, front end of the lever arm 46, with the rocker lever 31 installed (FIG. 1), is placed the switch tongue abutment 23, which forms a vertical stop for the lever arm 46. The lever shape and stop height are so matched to one another that the lever arm 46 acting on the switch spring is directly supported on the stop member 23 after overcoming the switching point for the switch spring and consequently the contact, as shown in FIG. 1, is opened, but before the switch spring overpresses over and beyond its elastic range and/or is pressed onto the switch spring support 22 or base 16. As a result of the stop limitation of the lever movement an absolutely effective overpressure protection for the switch spring is provided. It is also possible to provide such an overpressure protection in other temperature switches, e.g. those according to DE 196 27 969.

The rocker 41 is not a conventional lever substantially rigid over its entire force loading range, but is instead in the position to be substantially pressure-rigid or dimensionally stable below a predeterminable force limit, but dimensionally variable or flexible above said limit, in order to permit a certain decoupling of the force brought about by the diastat 5 from the lever arm 46 and/or the switch spring. This cushioning function is brought about by the clip spring 41 opening in stop-limited manner and which forms a self-restraining or self-limiting spring element. For creating symmetrical pressure ratios, the clip spring 41 is placed symmetrically between the support legs 48, 49. The lower leg 42 stabilized against bending by the wide stiffening corrugation 52 passing into the stamping 45 is a planar, one-piece extension of the lever arm 46. With a U-shaped bend 53, the lower leg 42 passes into the upper leg 43, stabilized by a pressed-in corrugation 54 and which is parallel to the lower leg with the spring fully open (FIGS. 1 to 3) and the fastening strap 36 is bent centrally upwards from said upper leg 43.

In the vicinity of the free end of the upper leg 43, in the area below the strap 36, are formed laterally U-shaped bending straps 55, 56, which in the shown, vertically downwardly bent state engage behind rectangular, lateral projections 57, 58 of the lever arm 46. As can be seen in FIG. 2*b*, the portion of the bending strap 55 engaging behind the particular projection 57 is curved convexly to the latter, so that when the spring is fully open in stop-limited manner the bending strap 55 is only supported in small-surface manner on a punctiform or linear contact point 59 on the underside of the projection 57. As a result of the precise supporting effect, an exact, vertical height (perpendicular to the lever arm 46) of the rocker reproducibly exists in this area.

In the opening direction of its legs, the clip spring 41 has a pretension, which is definitely higher than the limit force, which acts in the vicinity of the strap 36 or projections 57, 58 substantially perpendicular to the leg longitudinal direction, when the switch spring operating force has reached its switching point. This definition of the spring strength ensures that in the case of compressive loading by the diastat 5 the clip spring 41 acts for a sufficient time as a dimensionally rigid force transmission element until the switching point of the switch spring has been overcome and the contact 25, 27 has opened. Forces extending beyond this on the clip spring legs can bring about a compression of the legs, so that in the force flow between the diastat 5 and switch spring there is a reversible flexibility ensuring that no overpressure occurs.

It is particularly easy to fit a temperature regulator according to the invention, because for fitting the snap-action mechanism 20, 30 to the base 16 it is merely necessary to perform simple plugging and bending processes and the connection of the snap-action mechanism to the diastat 5 is brought about solely by a simple engagement contact between the large-area, planar underside 34 of the metal disk 35 and the cup-shaped top 33 of the insulating knob 32. Even in the case of small, lateral positional imprecisions of the diastat relative to the force transmission means, the switching ratios undergo substantially no change.

The complete snap-action mechanism can be prefitted as a subassembly to the base 16. For this purpose the parts of the snap switch are fixed to the base 16 by inserting in corresponding slots and turning the flat plug tongues 19 and twist straps 17, 29. The rocker 31, which is easy to handle as a one-piece sheet metal bent part is pressed from above over the snap switch support and is locked there by the snap securing action brought about by the noses 51. The insulating knob 32 can be mounted on the fastening strap 36 before or after the rocker is fitted. Fixing so as to prevent lifting or raising of the strap 36 is unnecessary, because in the assembled state and in the operation of the assembled switch the knob 32 is only compressively loaded.

The filled and soldered sensor/capillary tube/diastat 5 assemby is fixed to the retaining bolt 7. It is possible to use standardized expansion elements or diastats, because the expansion unit, other than for the need of providing a pressure surface for the insulator 32, need not be constructively adapted to the snap-action mechanism.

Setting and adjustment take place by means of the setscrew 14. In operation the control shaft 8 is turned for setting a given temperature, so that by means of the threads 9, 10 the diastat 5 can be brought into a given position along the control shaft axis 60. As a result of this setting the switch spring 21 is pretensioned to a greater or lesser extent and brought to a varying distance from its switching point.

On heating the temperature sensor 3, the expansion fluid contained therein expands and inflates the diastat 5, so that the metal disk 35 moves downwards and the lever 46 is pivoted counterclockwise in opposition to the force applied through the switch spring.

The switch spring is supported in such a way that in its unloaded state the outer end engages with the contact 25 on the countercontact 27, so that the switch is closed. The circuit connected by means of the flat plug tongues is closed by means of the snap spring and the switch is switched on.

If now the switching point is exceeded in that the switch spring is moved so far downwards that it snaps round and rests on the projection 26, then the switch is switched off. With the operating force occurring at this switching point on the operating position 47, as a function of the dimensioning and arrangement of the lever and the corresponding pressure points, there is a limited force directed at compressing the clip legs 42, 43. The force acting perpendicular to the legs in the vicinity of the strap 36 and displaced with respect to the knife-edge bearings 50 is transferred by means of the clip spring 41 without compressing the legs 42, 43, so that the entire rocker acts as a rigid operating element.

In normal operation, following the opening of the contact 25, 27 no further significant expansion of the diastat occurs, because the regulator has operated and the heating of a random electric heating device or other means acting on the sensor 3 is consequently normally switched off. If, by turning the control shaft 8 by means of a not shown operating knob, the user sets the regulator to a lower temperature or wishes to switch it off, he then moves the diastat further in the direction of the rocker 31, i.e. in the off direction.

The temperature regulator overpressure protection devices now come into action. For as long as the limit force on the clip spring is not exceeded, the legs 42, 43 cannot be compressed and the movement of the clip spring is purely a tilting movement. The limit force is set in such a way that on further overloading the switch spring can initially give further until the lever arm 46 rests on the stop member 23. Also in this maximum overpressure state of the switch spring, the forces and bending out effects acting thereon are still not in the elastic range thereof, so that no permanent damage can occur. On further increasing expansion the limit force is exceeded and the previously rigid clip spring then becomes elastically flexible. Under the compression of the legs 42, 43 it will give way and therefore protect itself and the expansion unit and the temperature switch parts carrying the same against any overpressure damage. The base 16 or switch spring support 22 can optionally have recesses, in which can be engaged the straps 55, 56, if constructionally the surface level of the base is not already low enough. The maximum overpressure path of the clip spring can be limited by the height of the frame opening in the strap. This necessary height is in turn predetermined by the maximum expansion or maximum travel of the membrane.

The cancelling out of the overload, e.g. on cooling the set device, the diastat 5 contracts and the clip spring 41 acting as a shock absorber returns to its starting shape shown in FIGS. 1 to 3 with a clearly defined maximum leg opening width.

The shock absorber-lever unit of operating lever 40 and shock absorber 41 created by the one-piece rocker 31 is consequently in the operating state absolutely pressure-rigid and only becomes flexible in the case of overload, but then returns precisely to its original shape and represents the transmission member of a force transfer means between the diastat and the snap switch. The spring elasticity in this shock absorber only comes into effect if switching has already taken place and merely serves to prevent overloading of the switch spring, but optionally also the actual rocker and the expansion unit.

Figure 5:
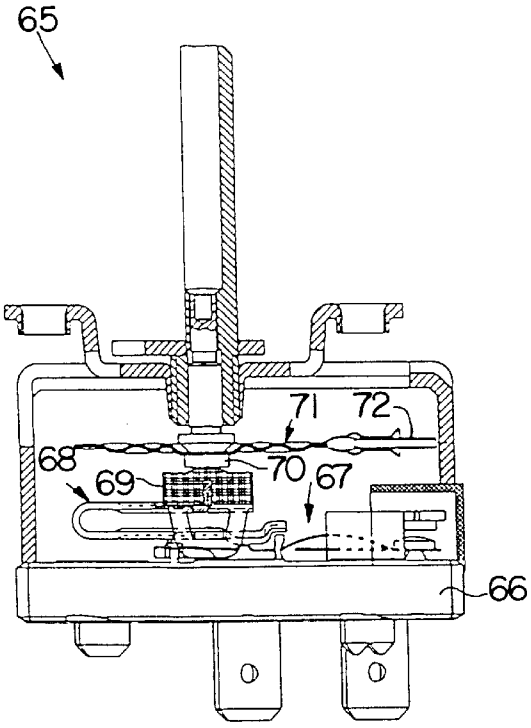
FIG. 5 Another embodiment of a temperature regulator with a flat membrane expansion capsule or diastat.

The embodiment of a temperature switch 65 shown in FIG. 5 has a particularly small overall height compared with the embodiment of FIG. 1. With an unchanged construction compared with FIG. 1 in the area of the base 66 and snap spring 67, as well as the one-piece rocker 68, in this embodiment a flatter, electrically insulating ceramic body 69 is provided, which when the temperature switch is assembled with its hemispherically curved top comes into punctiform pressure contact with a planar underside of a metal disk 70, which engages on the underside of a flat membrane diastat 71. Unlike in the case of the disk-like diastat 5 of FIG. 1, the capillary tube passes radially in the plane of the flat membrane directly into the interior of the corrugated, flat sheet metal halves of the diastat 71. Both the construction of the diastat as a flat membrane and the lateral introduction of the capillary tube 72 help to aid a particularly small overall height of this embodiment, whose assembly and function otherwise do not differ compared with the embodiment of FIG. 1.

Figure 7:
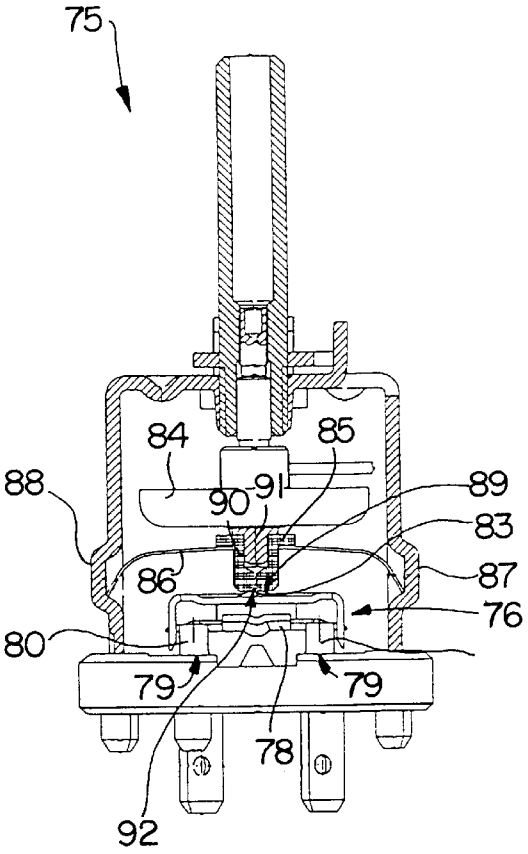
FIG. 7 A cross-section through the embodiment of FIG. 6.
Figure 6:
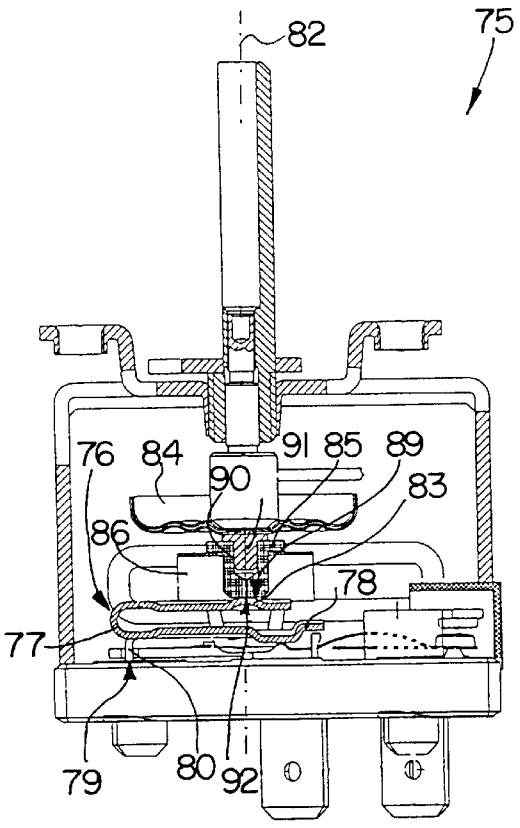
FIG. 6 Another embodiment of a temperature regulator with a different, one-piece buffer-lever unit and an insulator associated with the casing, in longitudinal section.

The embodiment of a temperature regulator 75 shown in FIGS. 6 and 7 essentially differs from the previously described embodiments through the shape of the one-piece rocker of the shock absorber-lever unit and by the provision of electrical insulation between the snap-action mechanism and the expansion unit. It is described relative to an expansion unit with an upwardly curved edge, similar to FIG. 1, but it is also possible to use a flat membrane like that of FIG. 5. With a substantially unchanged leg length of the clip spring, the rocker 76 has a lever portion 78 lengthened towards the U-bend 77 as compared with the previously described embodiments, so that the support legs 80, 81 forming the knife-edge bearing 79 are displaced from the control axis 82 into the vicinity of the U-bend. In the area of the control axis a hemispherically, upwardly directed stamping 83 of the upper clip leg is provided in place of the retaining strap for the insulator.

The insulator 85 electrically insulating the rocker against the expansion unit 84 is not fixed to the rocker, but is instead carried by a clip spring 86 shown in cross-section in FIG. 7, whose free legs are supported on opposite, outwardly projecting horizontal corrugations 87, 88 of the casing 89. The insulator 85 has a planar underside 89 with which it is supported in punctiform manner on the hemisphere 83 of the rocker and is provided on its top with an axial blind hole 90, in which is precisely inserted a bolt-like vertical lug 91 on the underside of the expansion unit 84.

Thus, the insulating knob 85 is pressed axially by means of a resilient sheet metal part 86 onto the membrane 84 and by its movable fixing to the casing becomes part of the fitting subassembly "casing". If the clip spring with insulator are inserted in the casing and subsequently the expansion unit is also installed, an upwardly directed, axial pretension provided by the clip spring 86 can eliminate any possible axial clearance in the vicinity of the adjusting or control unit, which can increase the setting precision.

On assembling the regulator, in the vicinity of the control axis between the planar underside 89 of the insulator 85 and the integral hemisphere 83 of the rocker acting as a sliding surface a pressure point 92 is formed. A functionally corresponding pressure point exists in the previously described embodiments between the planar underside of the expansion unit and the hemispherical top of the insulator. In the embodiment according to FIGS. 6 and 7 said pressure point is lower, i.e. closer to the plane of the knife-edge bearing 79. The knife-edge bearing is also further removed from the pressure axis coinciding with the control axis 82, so that the lever arm of the rocker 76 formed between the pressure point 92 and knife-edge bearing 79 is at a much more obtuse angle of e.g. 60° to the pressure axis 82 than the corresponding lever arm in the embodiments according to FIGS. 1 to 5. With the tilting movement of the rocker occurring at the switching point, there is also a clear reduction of the transverse movement associated with the sliding of the hemisphere 83 on the underside 89 as compared with the embodiments of FIGS. 1 to 5. As a result of the reduction of the transverse movement, which in unfavourable cases can be hindered by the tilting or hooking together of parts sliding on one another, the switching precision of the regulator can be increased.

There is a common advantage to all the embodiments that as a result of the subassembly created between the shock absorber and lever mechanism, said subassembly can be jointly fitted and the complete production of a temperature regulator can be brought about solely by positionally correct mounting on the buffer-lever unit of the expansion unit, optionally insulated by means of the casing-carried insulator, which is normally already fixed to the casing, without the casing subassembly with diastat and optionally insulator having to be fixed by separate fixing means or measures to the buffer-lever standard unit. As a result, in all the embodiments standardized diastats can be used, which reduces manufacturing costs. The electrical insulation can be associated with the shock absorber-lever unit, the casing or the expansion unit. The possibility of completely prefitting the snap-action mechanism with integrated shock absorber leads to the advantage that the operating point on the snap-action system is always precisely equal as a result of the clearly defined pivot mounting of the lever. Manufacturing tolerances with respect to the position of the control axis relative to the snap action mechanism have nor or only little influence on the switching precision due to the large-area, planar contact surface between the shock absorber-lever unit and the expansion unit or insulator.

What is claimed is:

1. Temperature switch comprising:

an expansion element;

a snap switch with a switch spring, wherein the switch spring switches at a switching point when an associated operating force acts on the switch spring; and force transfer means for coupling the expansion element and the switch spring such that the expansion element acts on the switch spring by means of the force transfer means;

overload prevention means for preventing overloading of the switch spring, wherein the overload prevention means comprise at least one buffer means, the buffer means cooperating with the force transfer means and being shape-variable when a force above a limit force associated with the operating force of the switch spring at the switch point acts on the buffer means, wherein the force transfer means and the buffer means form a one piece constructional unit.

2. Temperature switch according to claim 1, wherein the force transfer means comprise a lever mechanism with at least one lever, the lever having a lever arm acting on the switch spring.

3. Temperature switch according to claim 2, wherein the lever is supported on one side in the manner of a knife-edge bearing and wherein the lever comprises a lever arm acting on the switch spring on a punctiform operating point.

4. Temperature switch according to claim 1, wherein the force transfer means comprise at least one lever acting on the switch spring and wherein there is provided a stop member adapted to directly support the lever after overcoming the switching point for the switch spring in order to prevent damage to the switch spring.

5. Temperature switch according to claim 1, wherein there is provided a switch spring support for supporting the switch spring and wherein the switch spring support comprises a projection forming a stop member for the switch spring for supporting the switch spring after overcoming the switching point of the switch spring.

6. Temperatur switch according to claim 1, wherein the buffer means comprises at least one spring element being prestressed in a spring direction and being adapted to be self-restraining in the spring direction.

7. Temperature switch according to claim 6, wherein the spring element is formed as a clip spring with legs, the legs being prestressed in an opening direction of the legs and wherein there are provided stopping means for limiting the opening movement of the legs.

8. Temperature switch according to claim 7, wherein the stopping means comprise at least one hook constructed in one piece with one leg of the clip spring, and a projection provided on the other leg of the clip spring and wherein the hook engages behind the projection in such a way that the hook is supported on the projection accompanied by a prestressing of the spring element.

9. Temperature switch according to claim 1, wherein the force transfer means comprise a lever and wherein the buffer means comprise a spring element and wherein the spring element is constructed in one piece with the lever.

10. Temperature switch according to claim 9, wherein the lever has an L-shaped form with two support legs forming a knife-edge bearing for the lever and wherein a self-restraining spring element is placed symmetrically between the support legs.

11. Temperature switch according to claim 1, wherein the constructional unit formed by the buffer means and the force transfer means is a one-piece component.

12. Temperature switch according to claim 1, wherein the constructional unit formed by the buffer means and the force transfer means is a bent component made of spring sheet metal.

13. Temperature switch according to claim 1, wherein the expansion element comprises a diastat of a thermohydraulic expansion system.

14. Temperature switch according to claim 13, wherein the diastat is constructed as a flat membrane diastat.

15. Temperature switch according to claim 1, wherein in the assembled state of the temperature switch the expansion element contacts in unconnected engagement contact with at least one of the constructional unit formed by the buffer means and the force transfer means and an insulator element movably fixed to a casing of the temperature switch.

16. Temperature switch according to claim 1, wherein the constructional unit formed by the buffer means and the force transfer means is electrically insulated against the expansion element.

17. Temperature switch according to claim 16, wherein the constructional element formed by the buffer means and the force transfer means is supported on the expansion unit by means of an insulator element made of electrically insulating material.

18. Temperature switch according to claim 17, wherein the insulator element is fixed to the constructional unit formed by the buffer means and the force transfer means.

19. Temperature switch according to claim 17, wherein there is provided a spring element attached to a casing of the temperature switch and wherein the insulator element is fixed to the spring element in such a way that the insulator element is movable relative to the casing and that the spring element presses the insulator element onto the expansion unit.

20. Temperature switch according to claim 1, wherein a planar contact surface is associated with the expansion element and wherein the constructional unit formed by the buffer means and the force transfer means comprises a convexly curved support face cooperating with the planar contact surface to provide engaging contact between the contact surface and the support face in substantially punctiform manner.

21. Temperature switch according to claim 1, wherein the temperature switch is an adjustable temperature regulator.

22. Temperature switch comprising:

an expansion element;

a snap switch with a switch spring, wherein the switch spring switches at a switching point when an associated operating force acts on the switch spring; and force transfer means for coupling the expansion element and the switch spring such that the expansion element acts on the switch spring by means of the force transfer means;

overload prevention means for preventing overloading of the switch spring, wherein the overload prevention means comprise at least one buffer means, the buffer means forming a one-piece constructional unit with the force transfer means and being shape-variable when a force above a limit force associated with the operating force of the switch spring at the switch point acts on the buffer means, wherein the force transfer means comprise a lever mechanism with at least one lever acting on the switch spring and wherein there is provided a stop member adapted to directly support the lever after overcoming the switching point for the switch spring in order to prevent damage to the switch spring.

* * * * *

UNITED STATES PATENT AND TRADEMARK OFFICE

CERTIFICATE OF CORRECTION

PATENT NO. : 6,064,294
DATED : May 16, 2000
INVENTOR(S) : Schwarze et al.

It is certified that error appears in the above-identified patent and that said Letters Patent is hereby corrected as shown below:

Column 11, Claim 17,
Line 49, replace "element" with -- unit --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*